US008036562B2

(12) United States Patent
Mitsubori et al.

(10) Patent No.: US 8,036,562 B2
(45) Date of Patent: Oct. 11, 2011

(54) IMAGE FORMING APPARATUS AND METHOD OF THE SAME

(75) Inventors: Toshiyuki Mitsubori, Kawasaki (JP); Yasuyuki Kamai, Tokyo (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 391 days.

(21) Appl. No.: 12/408,022

(22) Filed: Mar. 20, 2009

(65) Prior Publication Data

US 2009/0269096 A1 Oct. 29, 2009

(30) Foreign Application Priority Data

Apr. 28, 2008 (JP) ..... 2008-117449

(51) Int. Cl.
*G03G 15/00* (2006.01)

(52) U.S. Cl. ..... 399/81

(58) Field of Classification Search ..... 399/75, 399/79–81; 345/156, 173, 184; 341/23
See application file for complete search history.

(56) References Cited

U.S. PATENT DOCUMENTS

| | | | | |
|---|---|---|---|---|
| 6,873,806 | B2 * | 3/2005 | Kobayashi et al. | 399/80 |
| 7,660,543 | B2 * | 2/2010 | Watanabe | 399/81 |
| 7,933,032 | B2 * | 4/2011 | Funahashi | 358/1.14 |

FOREIGN PATENT DOCUMENTS

| | | | |
|---|---|---|---|
| JP | 10-075322 | | 3/1998 |
| JP | 2003-044074 | | 2/2003 |
| JP | 2003-224695 | | 8/2003 |
| JP | 2008-011353 | A | 1/2008 |
| JP | 2008-225888 | * | 9/2008 |

OTHER PUBLICATIONS

Notice of Reasons for Refusal issued in the corresponding Japanese Patent Application No. 2008-117449 dated Jan. 29, 2010, and an English Translation thereof.

* cited by examiner

*Primary Examiner* — Hoan Tran

(74) *Attorney, Agent, or Firm* — Buchanan Ingersoll & Rooney PC

(57) ABSTRACT

An image forming apparatus 1 to form a panel sheet 100 placed at sections 111 to 113, 115 to 117 and 119 to 121 where operation buttons to be operated by a user are located, having a display 24*b* to display country setting screen to conduct country setting, operation buttons 24*a* at the sections 111 to 113, 115 to 117 and 119 to 121 to received operation to select a country in a state where the country setting screen to conduct country setting is being displayed on the display 24*b*. The panel sheet 100 corresponding to the language selected via the operation buttons 24*a* at the sections 111 to 113, 115 to 117 and 119 to 121.

6 Claims, 7 Drawing Sheets

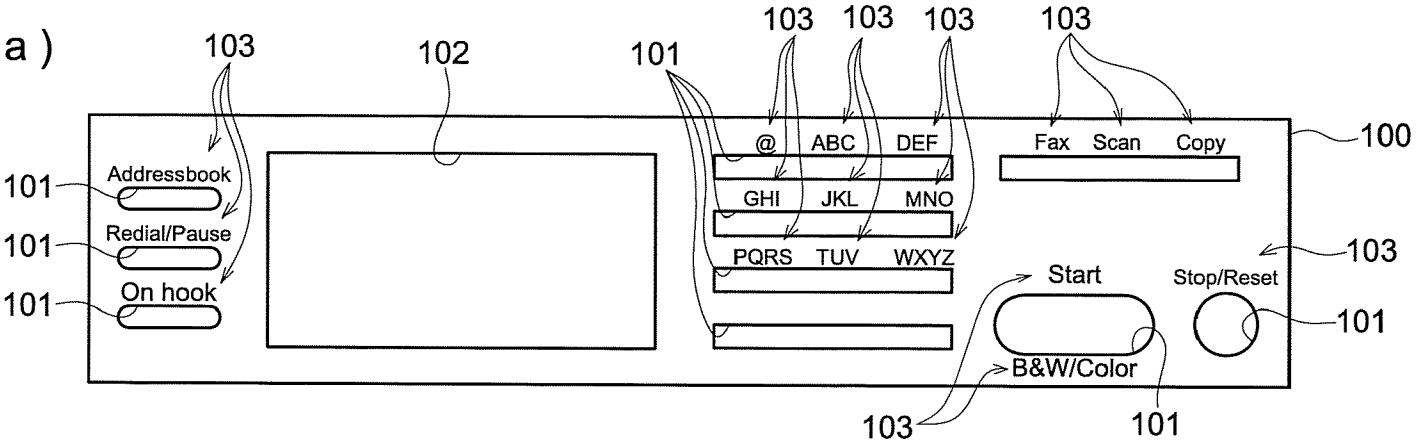
FIG. 3 ( a )
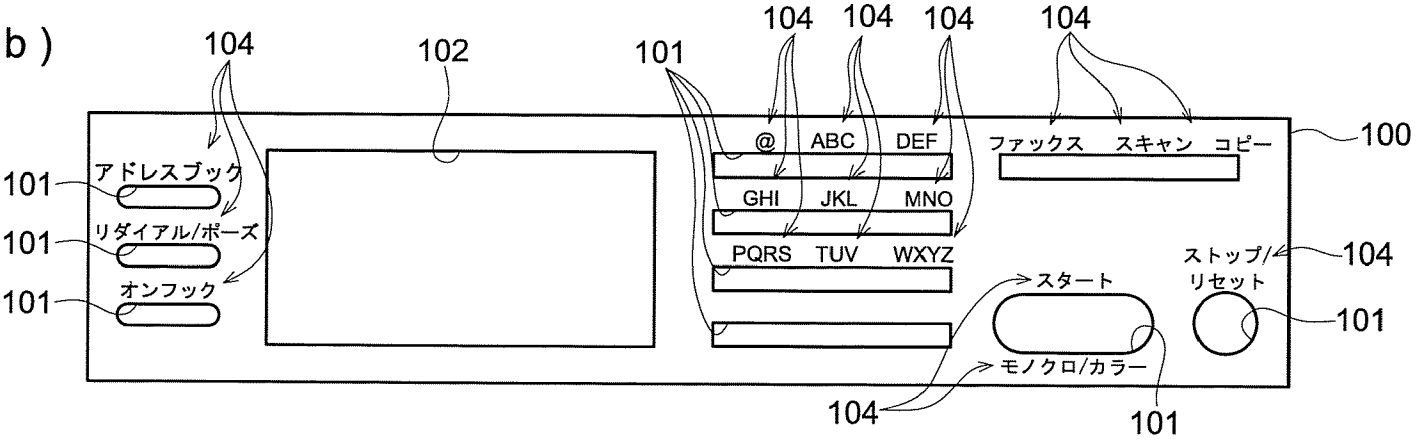
FIG. 3 ( b )

| ID1 | COUNTRY INFORMATION | ID2 |
|---|---|---|
| 0001 | Australia | 0001 |
| 0002 | China | 0007 |
| 0003 | France | 0002 |
| 0004 | Germany | 0003 |
| 0005 | Hong Kong | 0001 |
| 0006 | Italy | 0004 |
| 0007 | Japan | 0006 |
| 0008 | Portugal | 0001 |
| 0009 | Spain | 0008 |
| 0010 | Taiwan | 0007 |
| 0011 | USA | 0001 |

FIG. 8
| ID2 | LOCALIZED LANGUAGE INFORMATION | IMAGE/LANGUAGE DATA |
|---|---|---|
| 0001 | English | xxxxxxx.dat |
| 0002 | French | xxxxxxx.dat |
| 0003 | German | xxxxxxx.dat |
| 0004 | Italian | xxxxxxx.dat |
| 0005 | Russian | xxxxxxx.dat |
| 0006 | Japanese | xxxxxxx.dat |
| 0007 | Chinese | xxxxxxx.dat |
| 0008 | Spanish | xxxxxxx.dat |
FIG. 9
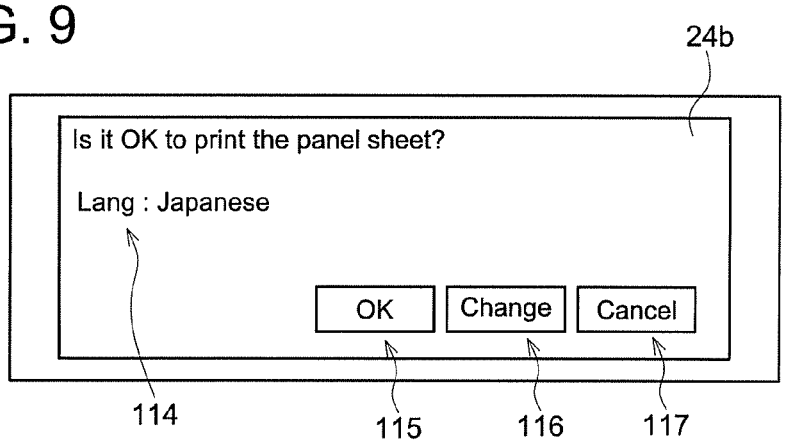
FIG. 10
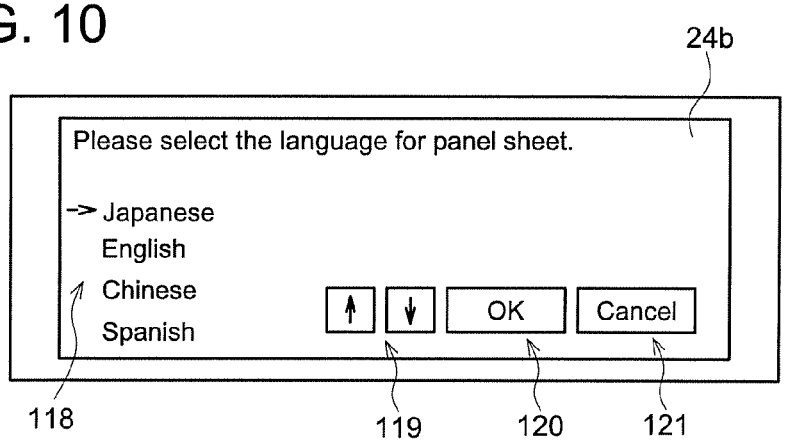

IMAGE FORMING APPARATUS AND METHOD OF THE SAME

BACKGROUND OF THE INVENTION

This application is based on Japanese Patent Application No. 2008-117449 filed on Apr. 28, 2008, in Japanese Patent Office, the entire content of which is hereby incorporated by reference.

TECHNICAL FIELD

The present invention relates to an image forming apparatus and a method.

BACKGROUND

In recent years, a facsimile apparatus in which a country setting (localization) can be achieved to adapt a communication standard which differs from among counties (Patent Document 1: unexamined Japanese patent application publication No. 2008-11353 and Document 2: unexamined Japanese patent application publication No. H10-75322).

In a conventional facsimile apparatus, in accordance with a country or region (hereinafter called country including both country and region) where the apparatus is actually used, the country setting is carried out so that communication setting of the apparatus conforms with the communication standard of the country where the apparatus is used. A large number of facsimile apparatuses are capable of the country setting by a user. However, concerning a panel sheet disposed at an operation button section which the user operates, a service staff brings an appropriate panel sheet to the user to install it or a set of the panel sheets for countries is supplied in a package at the time of delivery so that the user can install it. Thus in a former way, labor of the service staff to visit occurs or in a latter way, labor of manufacturing and administrating the panel sheet for each country occurs.

SUMMARY

The present invention has one aspect to solve the above problems and an object of the present invention is to provide an image forming apparatus and a method which save the labor of the service staff to visit and the labor of manufacturing and administrating the panel sheets.

To achieve the above object, the image forming apparatus reflecting one aspect of the present invention comprises: an operation section provided with a plurality of operation buttons to be operated by a user, wherein a panel sheet is to be placed at the operation section and has images describing functions of the plurality of the operation buttons; an acquisition section to acquire information regarding a language to be applied to the image forming apparatus; and an image forming section to output the panel sheet corresponding to the language acquired via the acquisition section.

In the aforementioned image forming apparatus, the acquisition section preferably acquires information regarding a country in which the image forming apparatus is used and information regarding the language based on the information regarding a country acquired.

Also in the aforementioned image forming apparatus, the acquisition section preferably acquires information regarding a country or information regarding the language based on an input from the operation section.

BRIEF DESCRIPTION OF THE DRAWINGS

These and other objects, advantages and features of the invention will become apparent from the following description thereof taken in conjunction with the accompanying drawings in which:

FIG. 3(*a*) is an example of a panel sheet for English language area;

FIG. 3(*b*) is an example of a panel sheet for Japanese language area;

FIG. 8 is a table showing languages to be acquired in step S17 shown by FIG. 5;

FIG. 9 is a view showing a printing confirmation screen displayed in step S8 shown by FIG. 5; and FIG. 10 is a view showing a local language selection screen displayed in step S22 shown by FIG. 5.

DETAILED DESCRIPTION OF PREFERRED EMBODIMENTS

The present invention will be described on the basis of an embodiment without the present invention being limited thereto.

Figure 1:
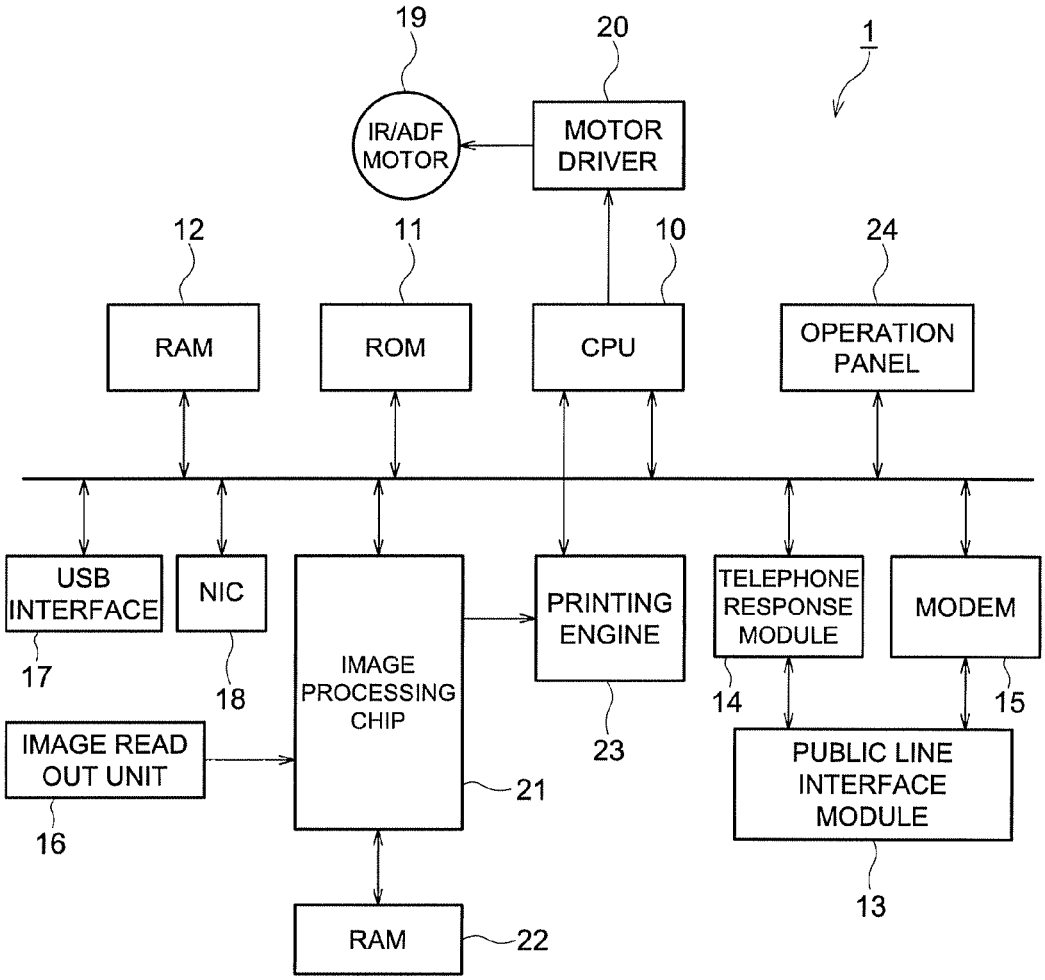
FIG. 1 is a block diagram of control showing a frame format of the image forming apparatus related to the present invention.

FIG. 1 is a block diagram showing a whole structure of an image forming apparatus related to the present embodiment. The image forming apparatus related to the present embodiment is, for example, MFP (Multi Functional Peripheral) including a copying function, a facsimile function, and a scanner function. As FIG. 1 shows, the image forming apparatus 1 is provide with a CPU (Central Processing Unit) 10, a ROM (Read Only Memory) 11, a RAM (Random Access Memory) 12, a public line interface module 13, a telephone response module 14 and a modem 15. Further, the image forming apparatus 1 is provided with an image reading unit 16 having a CCD (Charge Coupled Devices) image sensor, an USB (Universal Serial Bus) interface 17, NIC (Network Interface Card) 18, IR (Image Reader)/ADF (Auto Document Feeder) motor 19, a motor driver 20, an image processing chip 21, a RAM 22, a print engine 23 and an operation panel 24.

The CPU 10 to control entire image forming apparatus 1 conducts control of the scanner function, the facsimile function, the printing function and the copying function. The ROM 11 stores programs to be executed in the image forming apparatus 1 for scanning, facsimile, printing and copying. The RAM 12 temporary stores programs read out from the ROM 11 by the CPU 10 and various kinds of data. The CPU 10 executes each process in accordance with the program read out form the RAM 12.

The public line interface module 13 is an interface section connected to a public line network. The telephone response module 14 responds to incoming calls. The modem 15 modulates a digital signal into an analogue signal and demodulate vice versa.

The image reading unit 16 receives reflected light of a document image scanned through a scanning device equipped on the document table of the image forming apparatus by the CCD image sensor, and the reflected light is converted into image data via photoelectric conversion and analogue-digital conversion. Further, the USB interface 17 inputs a print job sent from a personal computer and outputs image data created based on an image signal obtained by scanning to the personal computer. The NIC 18 is an extension card to connect with the personal computer via LAN (Local Area Network), and to input and output the printing job sent from the personal computer in the same manner as USB interface.

The IR/ADF motor 19 is a motor to drive the reading device and the automatic document feeding device. The motor driver 20 drives and controls the IR/ADF motor 19.

The image processing chip 21 conducts processes such as magnification, image rotation, density adjustment, edge emphasizing, smoothing and binarization. The RAM 22 temporary stores image data and various calculation values in the course of image processing by image processing chip 21. Also, RAM 22 serves as a page memory to store image data of one page after image processing. The print engine 23 forms an image on a sheet based on the image data store in the RAM 22 representing the page memory.

Figure 2:
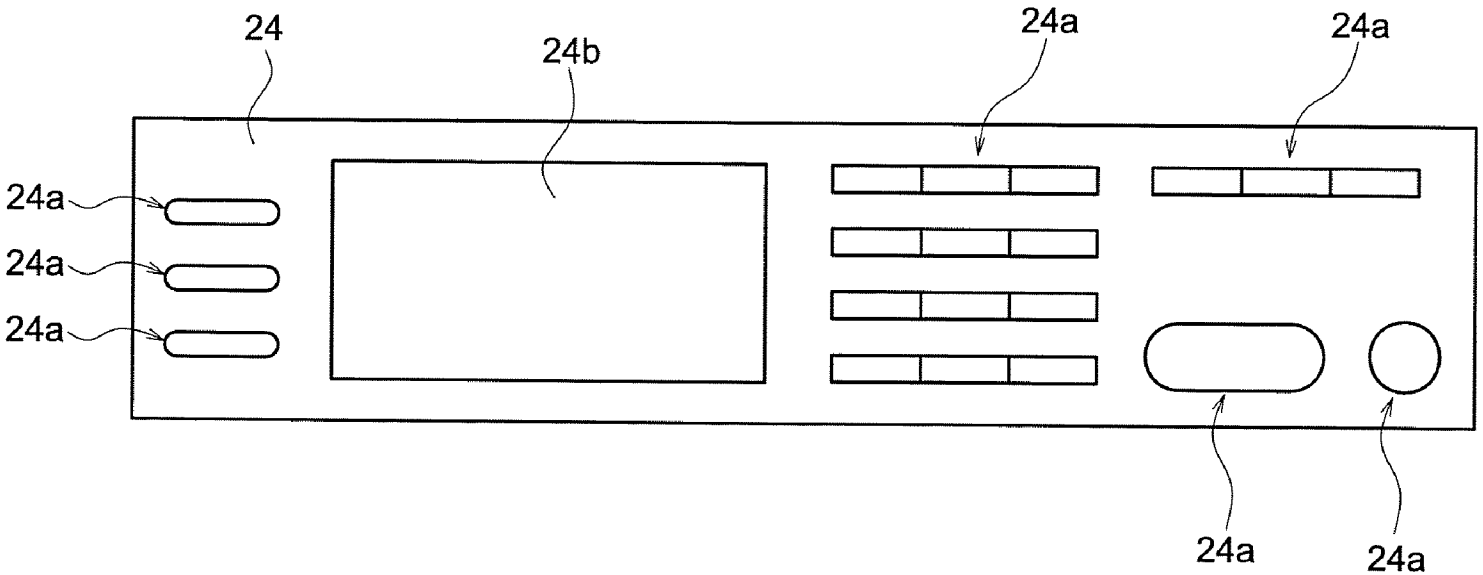
FIG. 2 is a front view showing an operation panel.

The operation panel 24 receives various settings and operational instructions from the user. FIG. 2 is a front view showing an operation panel 24 of the present embodiment. As FIG. 2 shows, the operation panel 24 is provided with various operation buttons 24*a* and a display 24*b*. The operation buttons 24*a* are, for example, composed of assignment buttons such as a fax, scan, and copy, a preset button, a start button, an address book button, a redial/pose button, an on hook button, and alphabet buttons. Also, the display 24*b* is configured by disposing a touch panel on the display screen, and the operation buttons (up down buttons 111 and 119, OK buttons 112, 115 and 120, a change button 116 and cancel buttons 113, 117 and 121 to be described later) are displayed on the display 24*b*. On the above display 24*b*, a copying screen where magnification at copying is possible, and a fax screen to indicate destinations of fax are displayed.

Also, on the above operation panel 24, a panel sheet is attached. FIG. 3 is an example of the panel sheet. FIG. 3(*a*) shows a panel sheet for English area, and FIG. 3(*b*) shows a panel sheet for Japanese language area. On the operation panel 24, the panel sheets 100 shown by FIG. 3(*a*) and FIG. 3(*b*) are provided. On the panel 100, openings 101 corresponding to each operation buttons 24*a* are formed. Also on the panel sheet 100, a rectangular opening 102 corresponding to the display 24*b* is provided. Further, on the panel sheet 100 shown by FIG. 3(*a*), English descriptions 103 to show a function of each operation button are inscribed so that the user in the English area can readily use. On the other hand, on the panel sheet 100 shown by FIG. 3(*b*), Japanese descriptions 104 to show a function of each operation button are inscribed so that the user in the Japanese language area can readily use.

In the above image forming apparatus 1, when a document is placed on the document table and a copying instruction is sent via the operation panel 24, the CPU 10 drives and controls the IR/ADF motor 19 via the motor driver 20, and the image reading unit 16 forms image data by receiving the reflected light of a scanned image. under control of the CPU 10, the image processing chip 21 receives the image data from the image reading unit 16, and conducts image processing in accordance with copying conditions assigned via the operation panel 24, then temporarily stores in the RAM 12. The data temporarily stored in the RAM 12 is supplied to the print engine 23 synchronously with operation of the print engine 23 via an exclusive video bus.

Also, when scanning is designated via the operation panel 24, the CPU 10 drives and controls the IR/ADF motor 19 via the motor driver 20, and the image reading unit 16 forms image data based on the reflected light of the document image. The image processing chip 21 receives the image data from the image reading unit 16 under control of the CPU 10, and conducts image processing in accordance with scanning conditions designated via the operation panel 24 then temporarily stores in the RAM 12. The data temporarily stored in the RAM 12 is converted, for example, into a file form such as a PDF file (Portable document Format) by the CPU 10, and outputted to an external devices via the USB interface 17 or the NIC 18.

Also, when fax is designated via the operation panel 24, the CPU 10 drives and controls the IR/ADF motor 19 via the motor driver 20, and the image reading unit 16 forms image data based on the document image. Under control of the CPU 10, the image processing chip 21 receives the image data from the image reading unit 16, and conducts image processing on the image data in accordance with fax conditions designated via the operation panel 24 then temporarily stores in the RAM 12. The data temporarily stored in the RAM 12 is supplied to the public line interface module 13 via the modem 15 to be sent to a destination fax machine.

Further, in case the print job is received from an outside via the USB interface or the NIC 18, the CPU 10 analyzes the print job and creates bit map image data, then compresses the data and send it to the image processing chip 21. The image processing chip 21 receives the compressed image data and expands the data. Then after image processing is applied to each pixel in accordance with image attribute of each pixel, the data is temporarily stores in the RAM 22. The data temporary stored in the RAM 22 is supplied to the print engine 23 to be printed.

Figure 4:
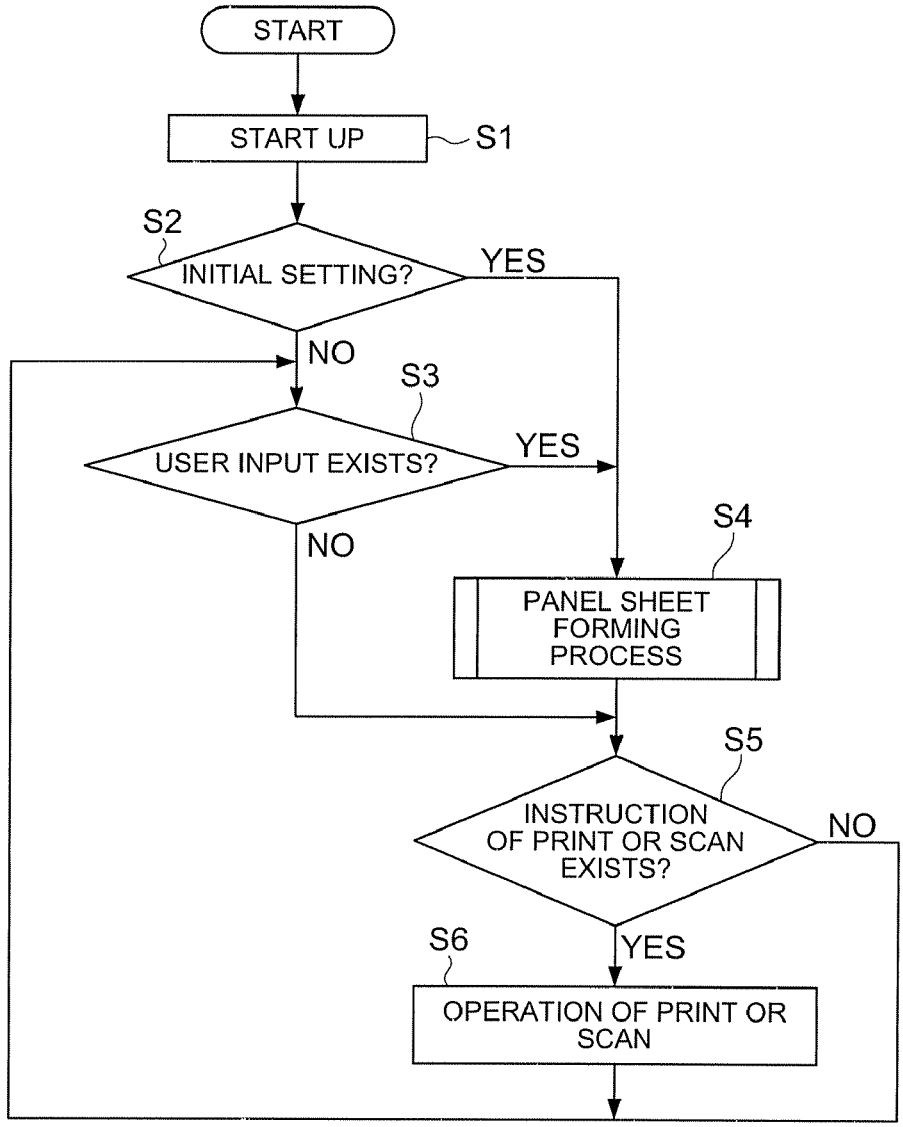
FIG. 4 is a flow chart showing an image forming method related to the present embodiment.

Here, the image forming apparatus 1 related to one exemplary embodiment of the present embodiment is capable of printing the panel sheet with a plurality of languages. Next, a process related to printing the panel sheet will be described. FIG. 4 is a flow chart showing image forming method related to one exemplary embodiment of the present embodiment. The process of the present flow chart is executed by the CPU 10 to download a program store in the ROM 11 to the RAM 12, and the RAM 12 is used as a work area. As FIG. 4 shows, when the power of the image forming apparatus 1 is turned on, a start-up process is executed (S1). Next, the CPU 10 judges whether or not an initial setting is necessary at first booting (S2). If it is judged that the initial setting is necessary, (S2: Yes), the process moves into step S4.

On the other hand, if it is judged that the initial setting is not necessary (S2: No), the CPU 10 judges where or not an operation input from the user via the operation buttons 24*a* exists. If it is judged that operation input form the user does not exist (S3: No), the process moves into step S5. Also, if it is judged that the operation input from the user exists (S3: Yes), the process moves into step S4.

In step S4, the CPU 10 executes a panel sheet forming process (S4). Then, the CPU 10 judges whether or not a scanning instruction exists in the operation input in step S3 and judges whether or not a printing instruction from an external personal computer exists (S5). When it is judged that any instruction does not exist (S5: No), the process moves into step S3.

On the other hand, if it is judged that the above instruction exists (S5: Yes), the CPU 10 executes an operation of printing or scanning (S6), and the process moves to step S3.

Figure 5:
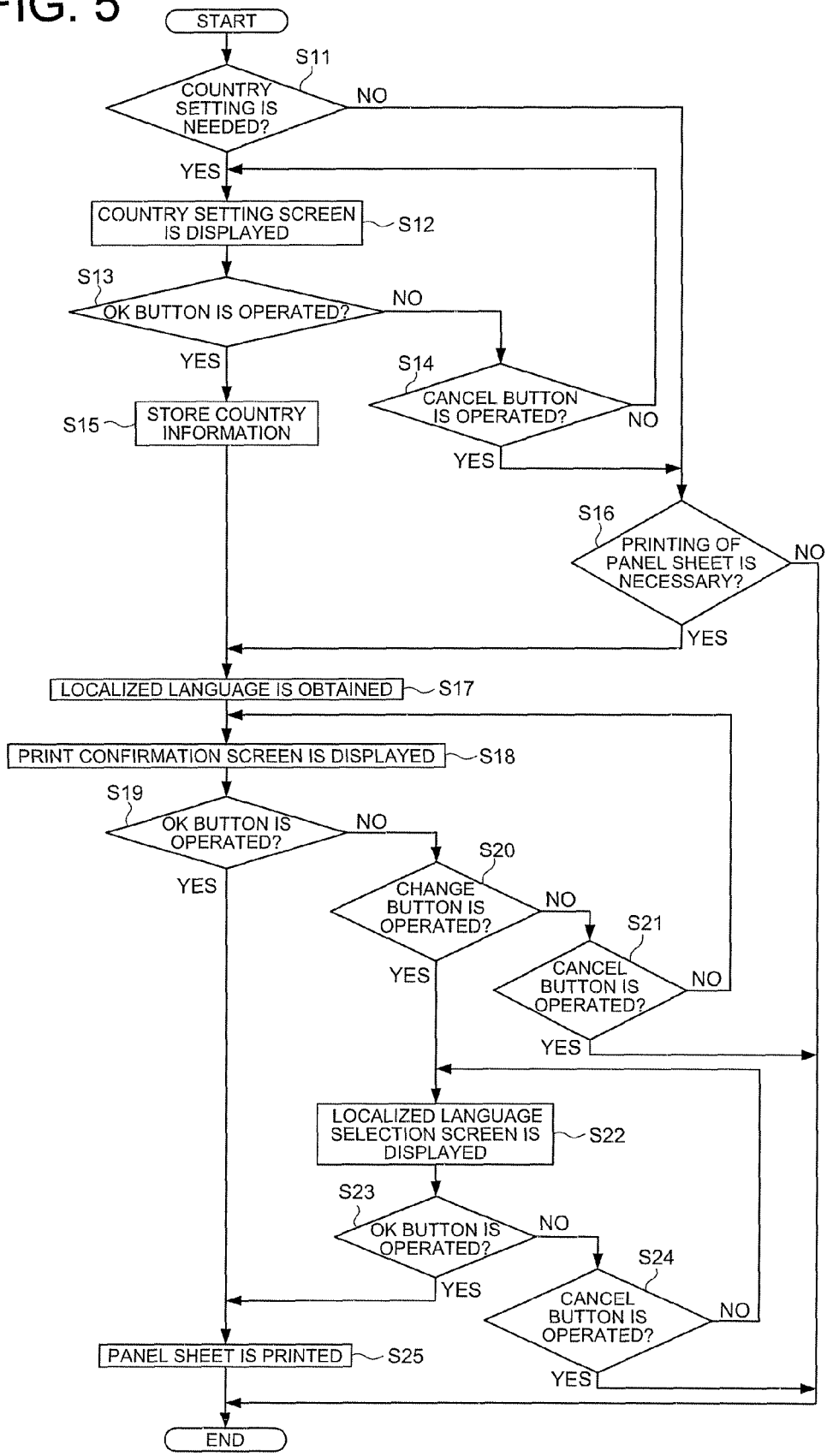
FIG. 5 is a flow chart showing detail of a panel sheet forming process (S4) shown by FIG. 4.

FIG. 5 is a flow chart indicating details of the panel sheet forming process (S4) shown by FIG. 4. In the panel sheet forming process, first, the CPU 10 judges whether country setting is necessary or not (S11). For example, in case the judgment in the step S2 shown by FIG. 4, is "Yes", or in case an operation for country setting exists in operation input of step S3, the CPU 11 judges that country setting is necessary (S11: Yes). At the very first booting in particular, since the communication standard of fax communication at the time of delivery does not conform to that of the country where the fax is actually used, the country setting is necessary to conform the standard.

Figures 6, 7:
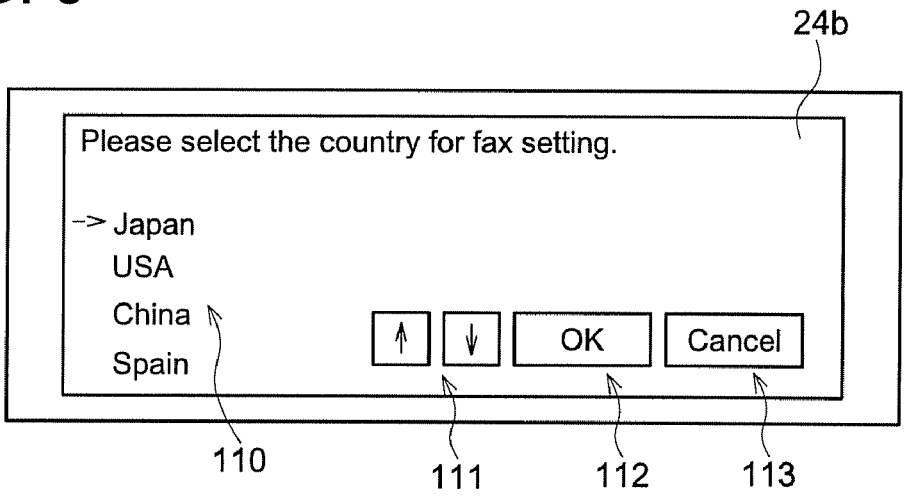
FIG. 6 is a view showing a country setting screen displayed in step S12.
FIG. 7 is a table showing country information.

By control of the CPU 10, the display 24*b* displays a country setting screen to carry out country setting (S12). FIG. 6 is a diagram showing the country setting screen displayed in step S12 shown in FIG. 5. As FIG. 6 shows, in the country setting screen, country information 110 available to be set is displayed. The user selects the country through the up-down button 111 displayed also in the country setting screen, and by operating the OK button 112, the user can carry out country setting. Also by operating the cancel button 113, the user can escape from the country setting screen.

Meanwhile, the country information 110 shown by FIG. 6, is stored in the ROM 11 in advance. FIG. 7 is a table showing country information. As FIG. 7 shows, ROM 11 stores ID1 and country information 110 in relationship to each other. When the country setting screen is required to be displayed, the CPU 10 reads out the data indicated by FIG. 7 from the ROM 11 and displays the country information.

Referring to FIG. 5 again, as described with reference to FIG. 6, after displaying the country setting screen, the CPU 10 judges whether or not the OK button 112 is operated (S13). If it is judged that the OK button is operated (S13: Yes), the CPU 10 acquires the set country information and stores the country information in the RAM 12 (S15). Then the CPU 10 conforms the communication standard of the facsimile in accordance with the information stored in the Ram 12. Thereafter, the process moves to step S17.

On the other hand, if it is judged that the OK button is not operated (S13: No), the CPU 10 judges whether or not the cancel button 113 is operated (S14). If it is judged that the cancel button 113 is not operated, (S14: No), the process moves to step S12. Or, if it is judged that the cancel button 113 is operated (S14: Yes), the process moves to step S16.

Meanwhile, in step S11, in case it is judged that the country setting is not necessary, (S11: No), the process moves to step S16. Then the CPU 10 judges whether printing of the panel sheet is necessary or not (S16). For example, in operation input in step S3 shown by FIG. 4, in case operation for printing the panel sheet 100 exists, the CPU 10 judges that printing of the panel sheet 100 is necessary (S16: Yes). Then the process moves to step S17. On the other hand, if it is judged that the printing of the panel sheet 100 is unnecessary (S16: No), a process shown by FIG. 5 is terminated and the process moves to step S5 shown by FIG. 4.

In step S17, the CPU 10 acquires information of local language (S17). In the process, the CPU 10 acquires information of local language based on information of country setting previously stored, namely the CPU 10 acquires language information for printing the sheet panel 100. When this occurs, the CPU 10 refers data shown by FIG. 7 and data shown by FIG. 8 to acquire local language information.

As FIG. 7 shows, the ROM 11 stores ID1 and country information 110 in relationship to each other, and further stores country information 110 and ID2 in relation ship. FIG. 8 is a table showing a correlation between ID2 and local language information, and a correlation between local language information and a data file name of actual image/language data. As FIG. 8 shows, the ROM 11 stores ID2, local language, the data file name of image/language data in relationship to each other. In step S17 shown by FIG. 5, a language is acquired based on the correlation shown by FIG. 8. For example, in case the country setting of Australia is assigned, the CPU 10 recognizes that local language is English and information of English is acquired as information of local language.

Then, the display 24*b* displays the country setting screen to conduct country setting (S18). FIG. 9 shows a printing confirmation screen displayed in step S18 shown by FIG. 5. As FIG. 9 shows, in the printing confirmation screen, information 114 of a local language is displayed in accordance with a country selected in the country setting screen. The user can conduct printing of the panel sheet 100 corresponding to the local language by operating the OK button 115 which also displayed in the printing confirmation screen. Also, by operating the change button 116, the user can move to the local language selection screen where the local language being displayed (in FIG. 9 Japanese) can be changed. Further the user can escape from the printing confirmation screen by operating the cancel button 117.

Referring to FIG. 5 again, as described with reference to FIG. 9, after displaying the printing confirmation screen, the CPU judges whether the OK button 115 is operated or not (S19). If the OK button 115 is judged to be operated (S19: Yes), the CPU causes the print engine 23 to drive and form an image in a shape conforming to the operation buttons 24*a* and the display 24*b* then print the panel sheet 100. Then, the process shown in FIG. 5 is terminated and moves to step S5 shown in FIG. 4.

On the other hand, if it is judged that the OK button 115 is not operated (S19: No), the CPU judges whether the change button 116 is operated or not (S20). If it is judged that the change button is not operated (S20: No), the CPU 10 judges whether the cancel button 117 is operated or not (S21). If it is judged that the cancel button 117 is not operated (S21: No), the process moves to step 18. Also, if it is judged that the cancel button 117 is operated (S21: Yes), a process shown by FIG. 5 is terminated and the process moves to step S5.

Meanwhile, if it is judged that the change button 116 is operated (S20: Yes), the display 24*b* displays a local language selection screen (S22). FIG. 10 shows a local language selection screen displayed in step S22 shown in FIG. 5. As FIG. 10 shows, in the local language selection screen, information 118 of local language shown by FIG. 8 is displayed. The user selects a country through the up-down button 119 which also displayed in the local language selection screen, and can print the panel sheet 100 corresponding to the local language by operating the OK button 120. Also, the user can escape from the local language selection screen by operating the cancel button 121.

Referring to FIG. 5 again, as described with reference to FIG. 10, after displaying the local language selection screen, the CPU 10 judges if the OK button 120 is operated (S23). If it is judged that the OK button is operated (S23: Yes), the CPU 10 causes to print the panel sheet 100 corresponding to the selected local language (S25). When this occurs, the CPU 10 causes the print engine 23 to drive and form an image in a shape conforming to the operation buttons 24*a* and the display 24*b* then print the panel sheet 100 as FIG. 3 shows. Then, the process shown in FIG. 5 is terminated and moves to step S5 shown in FIG. 4.

On the other hand, if it is judged that the OK button 120 is not operated (S23: No), the CPU 10 judges whether the cancel button 121 is operated or not (S24). If it is judged that the cancel button 121 is not operated (S24: No), the process moves to step 22. On the other hand, if it is judged that the cancel button 121 is operated (S24: Yes) a process shown by FIG. 5 is terminated and the process moves to step S5.

As above, according to the image forming apparatus 1 and the method related to the present embodiment, to obtain the panel sheet corresponding to the language of the country selected and set, an appropriate panel sheet is outputted from the image forming apparatus 1, therefore, labor of the service staff to visit does not occur, manufacturing of the panel sheet for each country is not necessary and labor of manufacturing and administration can be saved.

Also, in the local language selection screen, in case only language is selected via operation buttons 111 to 113, 115 to 117, and 119 to 112, since the panel sheet 100 corresponding to the selected language is outputted, an appropriate panel sheet can be outputted even if the communication standard does not conform with the local language, for example, in case of Japanese companies in overseas, though the communication standard is foreign standard, an operator to operate the image forming apparatus 1 is Japanese.

As above, the image forming apparatus and method related to one exemplary embodiment of the present invention have been described without the present invention being limited to the embodiment thereof, and it is to be understood that changes and variations may be made without departing from the spirit or scope of the appended claims.

For example, in the above embodiment, to conform to the communication standard of the facsimile, country information is selected and set, and in accordance a local language based on the country information, the panel sheet is printed. However, without being limited to the above, the panel sheet 100 can be printed in accordance with the local language based on acquired country information by acquiring information as the country information such as a serial number of a printer which can identify the countries.

Also, in the present embodiment, a multifunction peripheral is cited as an example, however a facsimile machine and a printer can be cited without being limited to the multifunction peripheral, as far as they are the image forming apparatuses having a function to acquire country information.

Further, while in the present embodiment, the example to only print the panel sheet 100 has been cited, an embodiment to display the local language on the display 24*b* is possible.

Also, in the above embodiment, the panel sheet 100 conforming to the local language in accordance with the country information or an input from the user is printed, however a panel sheet in accordance with a language of image data can be outputted by providing an image data input unit which inputs image data from an outside. Namely, the panel sheet 100 can be printed by analyzing a language of a document acquired by the scanner, a language of document printed by copying operation or printing operation, or a language in image data inputted via the USB interface or the NIC 18. Whereby an appropriate panel sheet 100 can be outputted by selecting the language in the data without the user to conduct country setting or language setting, thus the labor of the user to set language can be saved.

According to image forming apparatus and method related to one exemplary embodiment of the present invention, the appropriate panel sheet corresponding to the language to be used is outputted form the apparatus. Therefore, the labor of the service staff to visit a site where the apparatus is installed does not occur, and there is no necessity to manufacture the panel sheet for each country and to pack the set of panel sheet with the image forming apparatus for delivery. Therefore, the labor of the service staff to visit is eliminated and labor of manufacturing and administration can be saved.

What is claimed is:

1. An image forming apparatus, comprising:

an operation section provided with a plurality of operation buttons to be operated by a user, wherein a panel sheet having images describing functions of the plurality of the operation buttons is to be placed at the operation section;

an acquisition section to acquire information regarding a language to be applied to the image forming apparatus; and an image forming section to output the panel sheet corresponding to the language acquired via the acquisition section.

2. The image forming apparatus of claim 1, wherein the acquisition section acquires information regarding a country in which the image forming apparatus is used and information regarding the language based on the information regarding a country acquired.

3. The image forming apparatus of claim 1, wherein the acquisition section acquires information regarding a country or information regarding the language based on an input from the operation section.

4. An image forming method of an image forming apparatus having an operation section provided with a plurality of operation buttons to be operated by a user and a panel sheet to be placed at the operation section having images describing functions the plurality of the operation buttons, comprising steps of:

acquiring information regarding a language applied to the image forming apparatus;

forming the panel sheet corresponding to the language acquired in the step of acquiring; and outputting the panel sheet.

5. An image forming apparatus, comprising:

an acquisition section to acquire information regarding a language applied to the image forming apparatus and information regarding a country;

an operation section having a plurality of operation buttons to be used by a user;

an image forming section to form an image of a panel sheet having images describing functions of the plurality of the operation buttons on the operation section based on the information regarding the country acquired by the acquisition section; and a print output section to print and output the image of the panel sheet formed by the image forming section.

6. An image forming method, comprising steps of:

acquiring information regarding a language to be applied to an image forming apparatus and information regarding a country;

forming an image of a panel sheet having images describing functions of the plurality of operation buttons to be operated by a user on an operation section based on the acquired the information regarding the country in the acquiring step;

printing the image of the panel sheet formed in the forming step; and outputting the image of the panel sheet printed in the printing step.

* * * * *